United States Patent [19]

Hambrick et al.

[11] Patent Number: 4,645,380

[45] Date of Patent: Feb. 24, 1987

[54] DOCKING SYSTEM

[75] Inventors: John L. Hambrick, Pleasant Ridge; Ralph G. Poirot, Eastport, both of Mich.

[73] Assignee: Meliss Company, Royal Oak, Mich.

[21] Appl. No.: 729,942

[22] Filed: May 2, 1985

Related U.S. Application Data

[63] Continuation of Ser. No. 578,311, Feb. 10, 1984, abandoned, which is a continuation of Ser. No. 360,459, Mar. 22, 1982, abandoned.

[51] Int. Cl.[4] ..... E02B 3/20

[52] U.S. Cl. ..... 405/220; 114/263; 16/268

[58] Field of Search ..... 405/212, 215, 218–221; 114/219, 263, 267; 16/268, 269; 403/119

[56] References Cited

U.S. PATENT DOCUMENTS

| | | | |
|---|---|---|---|
| 1,170,106 | 2/1916 | Rockwell | 16/268 |
| 1,369,246 | 2/1921 | Jones | 16/268 |
| 2,948,121 | 8/1960 | Karst | 405/220 |
| 2,959,146 | 11/1960 | Erkert | 114/219 |
| 3,065,724 | 11/1962 | Tritt | 114/219 X |
| 3,073,274 | 11/1963 | Lamb | 405/219 X |
| 3,421,327 | 1/1969 | Donaldson | 405/220 |
| 3,492,825 | 2/1970 | Pearson | 405/219 |
| 4,078,515 | 3/1978 | Svirklys | 405/219 X |
| 4,107,932 | 8/1978 | Contrell | 405/220 |
| 4,126,006 | 11/1978 | Lewis | 405/220 |
| 4,212,564 | 7/1980 | Kay | 405/218 |
| 4,227,832 | 10/1980 | Leone et al. | 405/215 |

FOREIGN PATENT DOCUMENTS

| | | | |
|---|---|---|---|
| 951926 | 7/1974 | Canada | 405/218 |
| 1169672 | 11/1969 | United Kingdom | 16/268 |

*Primary Examiner*—Richard J. Scanlan, Jr.
*Assistant Examiner*—Nancy J. Stodola
*Attorney, Agent, or Firm*—Lyman R. Lyon

[57] ABSTRACT

The disclosure relates to a dock that is relatively easily assembled and disassembled. The dock comprises a number of dock sections, each of which is provided with a leg portion that engages the bottom of a lake or body of water. The opposite end of each dock section from the leg portion thereof is engaged with a preceding dock section by a locking system that facilitates erection of the dock system and maintenance thereof in the assembled condition.

1 Claim, 8 Drawing Figures

DOCKING SYSTEM

This is a continuation of co-pending application Ser. No. 578,311 filed on Feb. 10, 1984, which is a continuation of application Ser. No. 360,459 filed Mar. 22, 1982, both now abandoned.

BACKGROUND OF THE INVENTION

Boat docks employed in lakes subject to freezing are generally removed late in the fall prior to the first freeze. Failure to remove a dock from a lake that freezes over subjects the dock to twisting and heaving forces due to ice movement during the winter months and incident to melting of the ice in the spring. In most cases, such docks consist of a series of posts driven into the lake bed for the support of transverse members which, in turn, support a plurality of horizontal planks. Such docks are generally incapable of assembly from the end of an existing or previously assembled portion of the dock. Moreover, disassembly of the dock system requires entry into the water to effect removal of each section of dock.

SUMMARY OF THE INVENTION

A docking system in accordance with the instant invention obviates the requirement for entry into the water to effect erection or disassembly thereof. Lightweight sections are successively hooked to one another and positively controlled by a mechanical interlocking feature during the assembly operation.

DETAILED DESCRIPTION OF THE PREFERRED EMBODIMENT OF THE INVENTION

Figure 1:
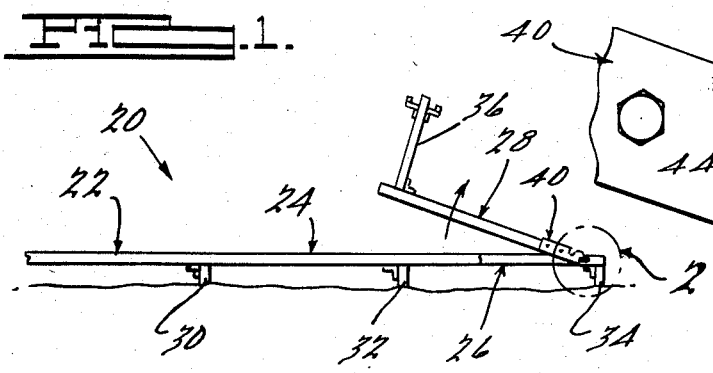
FIG. 1 is a side elevational view of three assembled sections of the dock system assembled with a fourth end section at the first stage of rotation to its assembled condition.

Referring to FIG. 1 of the drawings, a dock system 20 in accordance with a constructed embodiment of the instant invention, comprises a plurality of aligned dock sections 22, 24, 26 and 28, the section 28 being an end or terminal section of the dock 20. The dock sections 22, 24, 26 and 28 are provided with post assemblies 30, 32, 34 and 36, respectively, each of which is at a height dictated by the depth of the water at the particular location of the section. Since each of the dock sections 22, 24, 26 and 28 is similar in construction, only the dock section 28 will be discussed in detail hereinafter.

Figure 2:
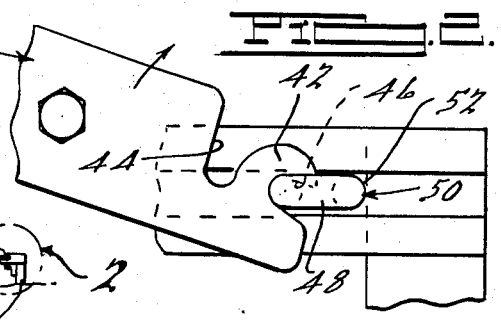
FIG. 2 is a view taken substantially within the circle 2 of FIG. 1.

As best seen in FIG. 2 of the drawings, the dock section 28 is provided with locking plates 40 on both sides thereof that extend longitudinally beyond the end of the section 28. Each of the plates 40 has a gooseneck 42 and slot 44 at the end thereof. The gooseneck 42 has a forwardly facing slot 46 for engagement with a pin portion 48 of a U-shaped retainer 50 to both limit advancement of the inverted dock section relative to an assembled section 26 and function as a journal about which the gooseneck 42 rotates as the section 28 rotates to the assembled condition. The retainer 50 has a pin portion 52 in spaced relation to the pin 48 that is accepted within the slot 44 in the plate 40, as will be described.

Figure 3:
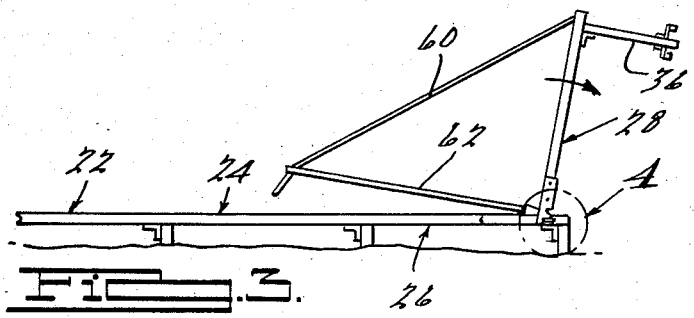
FIG. 3 is a view similar to FIG. 1 with a gin pole and rope attached to the end dock section and with the section rotated to an intermediate assembly position.

Referring to FIG. 3 of the drawings, the end section 28 is shown elevated to a vertical condition. A rope 59 is shown attached to the outer end portions of both the dock sections 28 and a gin pole 62. The gin pole 62 and rope 59 are not part of the permanent structure of the dock system 20 but merely facilitate assembly thereof by maximizing the leverage available to hold the section 28 during rotation to the locked condition.

Figure 4:
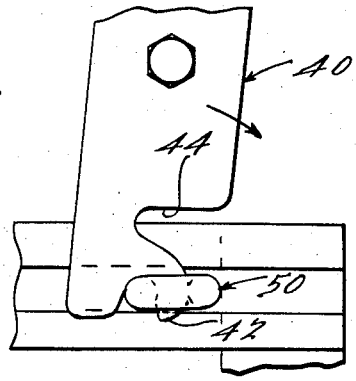
FIG. 4 is a view taken within the circle 4 of FIG. 3.
Figure 5:
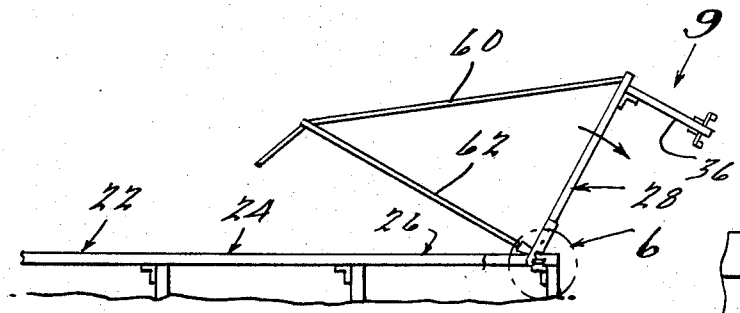
FIG. 5 is a view similar to FIG. 3 of the end dock section rotated to a substantially assembled condition.
Figure 6:
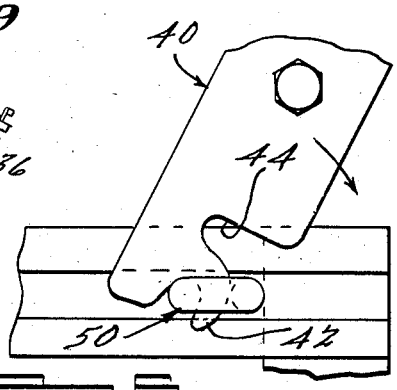
FIG. 6 is a view taken within the circle 6 of FIG. 5.
Figure 7:
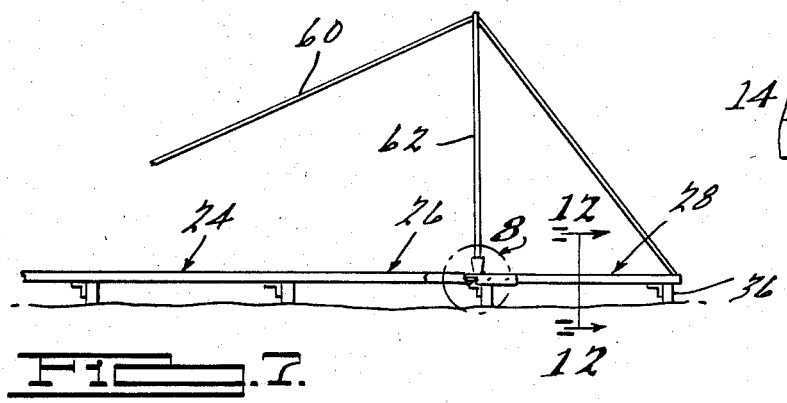
FIG. 7 is a view similar to FIG. 1 with the end dock section in the fully assembled and interlocked condition.
Figure 8:
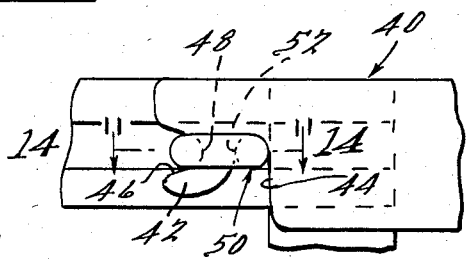
FIG. 8 is a view taken within the circle 8 of FIG. 7.

As seen in FIG. 6 of the drawings, the gooseneck 42 is advanced between the pins 48 and 52 to positively control the section 28 during rotation thereof to the horizontal condition relative to the previously installed section 26. By comparing FIGS. 3, 5 and 7 as well as FIGS. 4, 6 and 8, it will be noted that the gooseneck 42 is advanced into the retainer 50 until the slot 44 thereof accepts the pin 52. When the plate 40 is positioned as shown in FIGS. 7 and 8, the gooseneck 42 thereof positively locks the dock section 28 to the dock section 26 by precluding both relative longitudinal and lateral movement between the dock sections 26 and 28.

From the foregoing description it should be apparent that sections of the dock are interlocked by a novel system that provides for fast positive assembly thereof as well as positive retention of the dock sections in longitudinal alignment with one another.

We claim:

1. A portable docking system comprising:

a first dock section having a pair of gooseneck retainers extending oppositely and laterally outwardly from a pair of side faces thereof, respectively, and a second dock section having an end face with a pair of U-shaped goosenecks extending longitudinally beyond said end face, said goosenecks opening in a direction away from the end face on said second dock section and being engageable with the gooseneck retainers of said first dock section, respectively, upon movement of said goosenecks in one direction toward said gooseneck retainer, further movement of said second dock section in said one direction effecting locking of said goosenecks in said gooseneck retainers.

* * * * *